US009022805B2

(12) United States Patent
Lai et al.

(10) Patent No.: US 9,022,805 B2
(45) Date of Patent: May 5, 2015

(54) CABLE MANAGEMENT APPARATUS

(71) Applicant: Giga-Byte Technology Co., Ltd., New Taipei (TW)

(72) Inventors: Chih Ming Lai, New Taipei (TW); Ya Han Chang, New Taipei (TW); Yung Shun Kao, New Taipei (TW)

(73) Assignee: Giga-Byte Technology Co., Ltd., New Taipei (TW)

( * ) Notice: Subject to any disclaimer, the term of this patent is extended or adjusted under 35 U.S.C. 154(b) by 0 days.

(21) Appl. No.: 13/889,230

(22) Filed: May 7, 2013

(65) Prior Publication Data

US 2014/0187083 A1 Jul. 3, 2014

(30) Foreign Application Priority Data

Dec. 27, 2012 (TW) ..... 101150674 A

(51) Int. Cl.
*H01R 13/40* (2006.01)
*H01R 9/24* (2006.01)
*H01R 13/518* (2006.01)

(52) U.S. Cl.
CPC ..... *H01R 9/2416* (2013.01); *H01R 13/518* (2013.01)

(58) Field of Classification Search
CPC ..... H01R 13/501
USPC ..... 439/79, 579, 491, 596, 467, 701, 660, 439/904, 905, 731, 942
See application file for complete search history.

(56) References Cited

U.S. PATENT DOCUMENTS

| | | | | | |
|---|---|---|---|---|---|
| 4,758,183 | A * | 7/1988 | Aoyama | 439/596 |
| 4,878,853 | A * | 11/1989 | Yamade et al. | 439/596 |
| 4,897,046 | A * | 1/1990 | Tengler et al. | 439/579 |
| 5,380,220 | A * | 1/1995 | Okabe | 439/456 |
| 5,898,130 | A * | 4/1999 | Tansi et al. | 439/491 |
| 5,997,337 | A * | 12/1999 | Torii | 439/399 |
| 6,843,682 | B2 * | 1/2005 | Matsuda et al. | 439/596 |
| 7,011,543 | B2 * | 3/2006 | Hiramoto et al. | 439/405 |
| 7,270,565 | B2 * | 9/2007 | Kamata et al. | 439/491 |
| 8,333,609 | B2 * | 12/2012 | Sato et al. | 439/491 |
| 8,643,476 | B2 * | 2/2014 | Pinn et al. | 439/491 |
| 2013/0095703 | A1 * | 4/2013 | Liang | 439/660 |
| 2013/0164989 | A1 * | 6/2013 | Zhu et al. | 439/660 |

OTHER PUBLICATIONS

"Molex—Product of the Quarter Videos—Unsealed Connectors", <https://www.youtube.com/watch?v=6pYEIsUjzeQ>, posted on Oct. 17th, 2012.

"Molex—MINI50 Single Row Receptacle Sales Drawing", http://www.molex.com/pdm_docs/sd/347910041_sd.pdf, posted on Nov. 21st, 2011.

* cited by examiner

*Primary Examiner* — Tho D Ta
(74) *Attorney, Agent, or Firm* — Chun-Ming Shih

(57) ABSTRACT

A cable management apparatus includes a half housing and a plurality of partitions. The half housing has a first side surface and a second side surface opposite to each other. The partitions are disposed in the half housing to divide the interior of the half housing into a plurality of compartments, and each compartment extends to the two faces of the half housing. A plurality of signal cables are respectively disposed into the compartments, so that the signal cables are able to be disposed in the electronic slots through the half housing and that the signal cables are electronically connected to the corresponding pins respectively.

5 Claims, 12 Drawing Sheets

CABLE MANAGEMENT APPARATUS

CROSS-REFERENCES TO RELATED APPLICATIONS

This non-provisional application claims priority under 35 U.S.C. §119(a) on Patent Application No. 101150674 filed in Taiwan, R.O.C. on 2012 Dec. 27, the entire contents of which are hereby incorporated by reference.

BACKGROUND

1. Technical Field

This disclosure relates to a cable management apparatus, and more particularly to a cable management apparatus used to fix multiple signal cables on a motherboard.

2. Related Art

With the advance of audio and video applications, electronic devices are developed toward high performance, compactness, scalability. With different application needs, the connector technology is substantially improved as well. For example, Display Port, DVI, and HDMI are common used connectors. These connectors use digital transmission to enhance the display quality of the electronic devices and are connected to the adapter, set-top boxes, DVD players, personal computers, integrated amplifier, and digital audio. These connectors have advantages of high transmission speed, long transmission distance, and high transmission quality, so the market demands substantially increase, such that many product manufacturers are committed to R&D of connectors.

Now most circuit boards include board-to-board connectors with scalability and connection function, so as to physically and electronically connect two circuit boards, when a circuit board is connected to another circuit board. Most signal cables of conventional board-to-board connectors are round or flat cables, and signal lines in cables are connected to the corresponding signal lines via an electronic slot of a circuit board. However, the definitions of the upper and the lower terminals of general high-frequency connector and the pins of the circuit board are different, so the connecting ends of the signal cables must be connected to the corresponding pins of the circuit board. While assembling, signal cables should be electronically connected to the corresponding pins of the circuit board one by one, resulting in complex process procedure and low production efficiency and product quality.

Therefore, how to make signal cables easily and quickly match the corresponding pins is an important issue.

Besides, when a board-to-board connector is placed in an electronic slot of a circuit board, the connector often occupies a certain space above the electronic slot, such that other electronic components can not be successfully disposed on the circuit board or are offset or loosen from the circuit board by the board-to-board connector.

SUMMARY OF THIS DISCLOSURE

In view of the above problems, this disclosure provides a cable management apparatus, so as to solve the issue that conventional signal cables should be connected to the pins one by one and that the positioning of the signal cables is difficult, resulting in complex process procedure and low production efficiency and product quality.

The cable management apparatus is used to direct a plurality of signal cables electronically connected to an electronic slot of a circuit board. Each signal cable includes a connector and a line body, and plural pins are disposed in the electronic slot. The cable management apparatus includes two half housings. The two half housings respectively include a first side surface and a second side surface opposite to each other, wherein the first side surface of the two half housings are connected to each other, while the second side surfaces of the two half housings are able to be connected or separated. The structure of the two half housings matches the shape of the electronic slot, and the two half housings are able to be placed in the electronic slot when the second side surfaces of the two half housings are connected to each other. Each of the first side surfaces includes a plurality of pinholes, and the pinholes respectively correspond to the pins of the electronic slot. Each of the second side surfaces includes a plurality of fastening grooves, and the fastening grooves respectively correspond to the pinholes of the first side surfaces. When the connectors of the signal cables are disposed in the half housing, the line bodies of the signal cables are stuck in the corresponding fastening grooves and the connectors respectively corresponds to the pinholes.

This disclosure provides another cable management apparatus, which is used to direct a plurality of signal cables to be electronically connected to an electronic slot of a circuit board. Each signal cable includes a connector, and plural pins are disposed in the electronic slot. The cable management apparatus includes a half housing and a plurality of partitions. The half housing includes a first side surface and a second side surface opposite to each other. The partitions are disposed in the half housing and divide the interior of the half housing into a plurality of compartments. Each compartment extends to the two opposite face of the half housing and corresponds to the corresponding pin. The connectors of the signal cables are respectively disposed in the compartments and are placed in the electronic slot via the half housing.

In the cable management apparatus, the signal cables are fixed in the cable management apparatus and are placed respectively corresponding to the positions of the pins, so that the entire group of signal cables are placed in the electronic slot and that the assembling and positioning corresponding are easy and quick. Besides, the cable management apparatus merges into the electronic slot when the cable management apparatus is inserted in the electronic slot, so that the space occupied by the connectors is reduced and that the obstruction to other electronic components is reduced, making the product more reliable.

The detail of this disclosure can be better appreciated from the following detailed description of this disclosure, taken in conjunction with the attached drawings.

BRIEF DESCRIPTION OF THE DRAWINGS

This disclosure will become more fully understood from the detailed description given herein below for illustration only, and thus not limitative of this disclosure, wherein.

DETAILED DESCRIPTION OF THE DISCLOSURE

Figure 1:
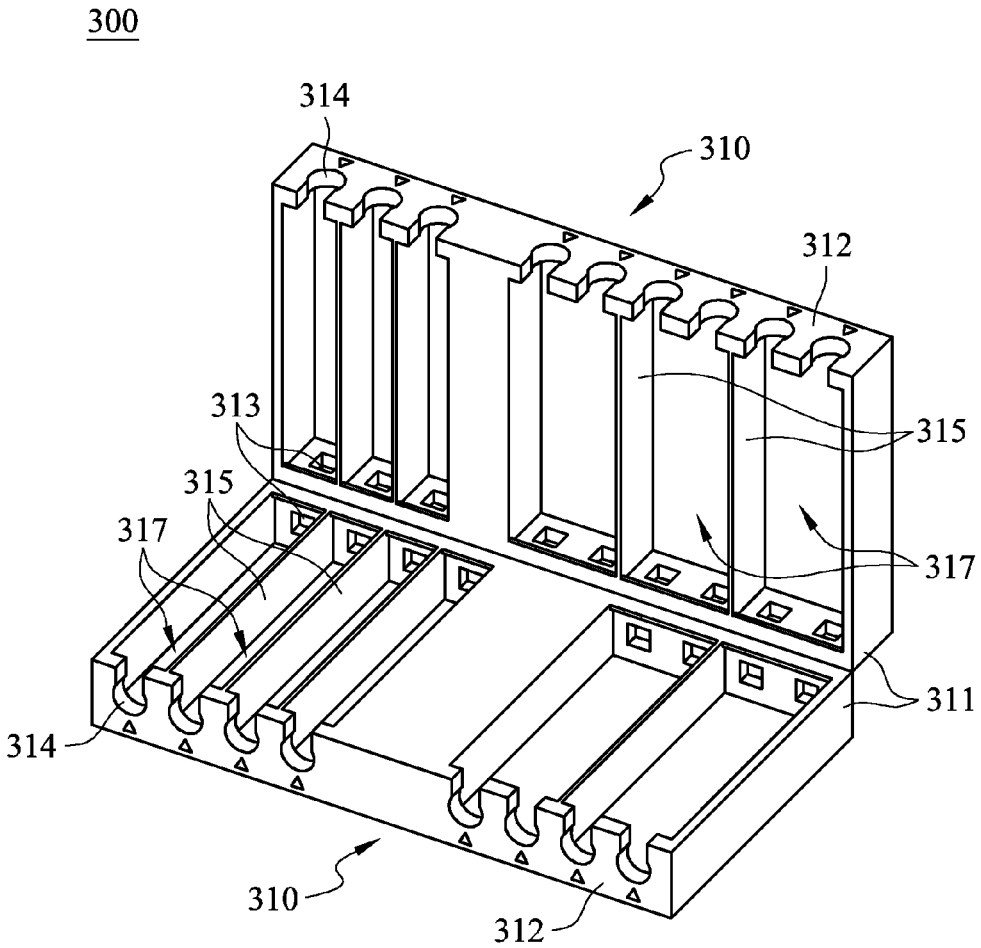
FIG. 1 is a perspective view of the cable management apparatus according to a first embodiment.
Figure 2:
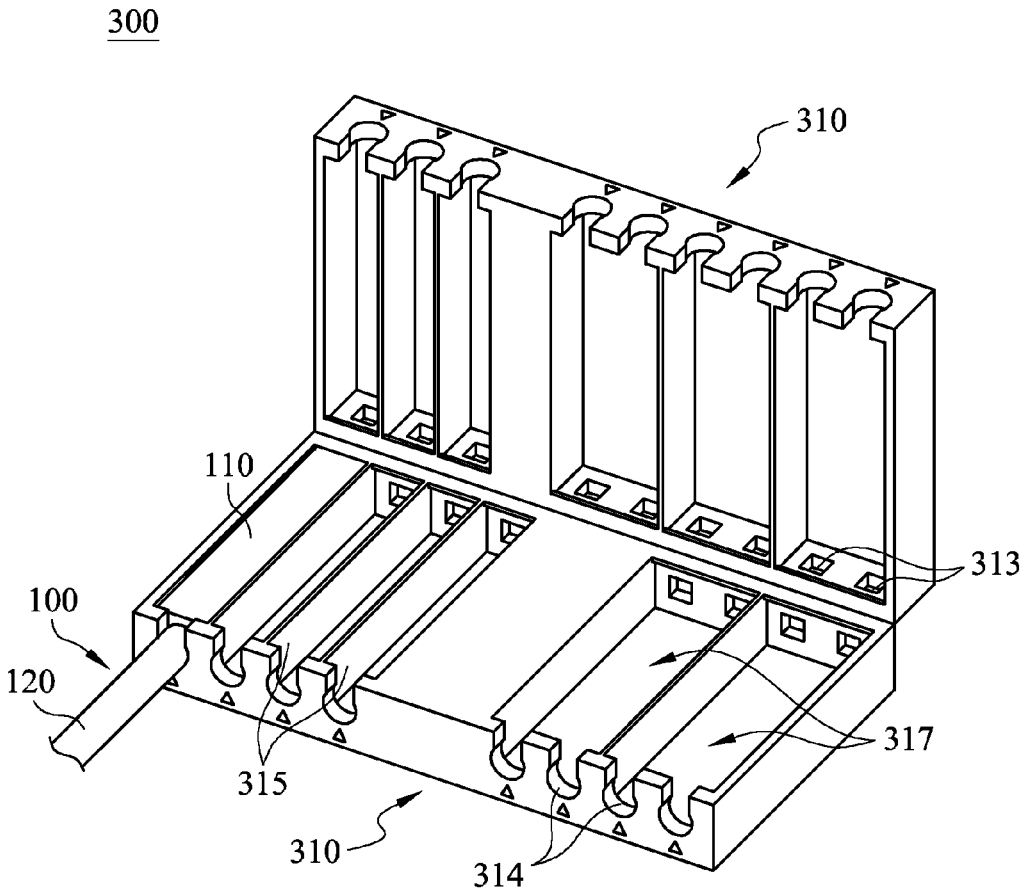
FIG. 2 is a perspective view of the cable management apparatus with one signal cable disposed inside according to the first embodiment.

Refer to FIG. 1 to FIG. 7, a cable management apparatus 300 according to the first embodiment is used to direct a plurality of signal cables 100 electrically connected to an electronic slot 210 of a circuit board 200. Each of the signal cables has a connector 110 and a line body 120, and a plurality of pins 211 are disposed in the electronic slot 210, such that the signal cables 100 can be electronically connected to pins 211 in the electronic slots 210.

The cable management apparatus 300 according to the first embodiment includes two half housings 310. The material of the half housings 310 could be plastic or rubber, not limited as described herein. Each of the half housings 310 has a first side surface 311 and a second side surface 312 opposite to each other. The two half housings 310 are connected by one side of the first side surfaces 311, that is, the first side surfaces 311 of the two half housings 310 are connected to each other. The second side surfaces 312 of the two half housings 310 can be closed or separated, so that the cable management apparatus 300 can be opened or closed. When the second side surfaces 312 of the two half housings 310 are closed, the interior of the half housing 310 forms an accommodation space, so as to provide a room to place a plurality of signal cables 100. The shape of the half housing 310 is a cuboid and matches that of the electronic slot 210, and the half housing 310 can be inserted into the electronic slot 210.

Furthermore, the first side surface 311 of each half housing 310 includes a plurality of pinholes 313 respectively corresponding to the pins 211 of the electronic slot 210 of the circuit board 200, and the pinholes 313 respectively run through the first side surface 311 and communicate interior and exterior of the half housing 310. The second side surface 312 of each half housing 310 includes a plurality of fastening grooves 314; the shapes of these fastening grooves 314 could be but not limit to U-shaped, semi-circular or keyhole-shaped openings, and those fastening grooves 314 respectively correspond to the positions of the pinholes 313 of the first side surface 311.

Therefore, when the connector 110 of the signal cable 100 is placed in the half housing 310 of the cable management apparatus 300, the line body 120 of the signal cable 100 is able to be fixed to one of the fastening grooves 314, such that the signal cable 100 is fixed to the cable management apparatus 300 and that the electronic hole of the connector 110 corresponds to the corresponding pinhole 313 of the half housing 310.

Figure 3:
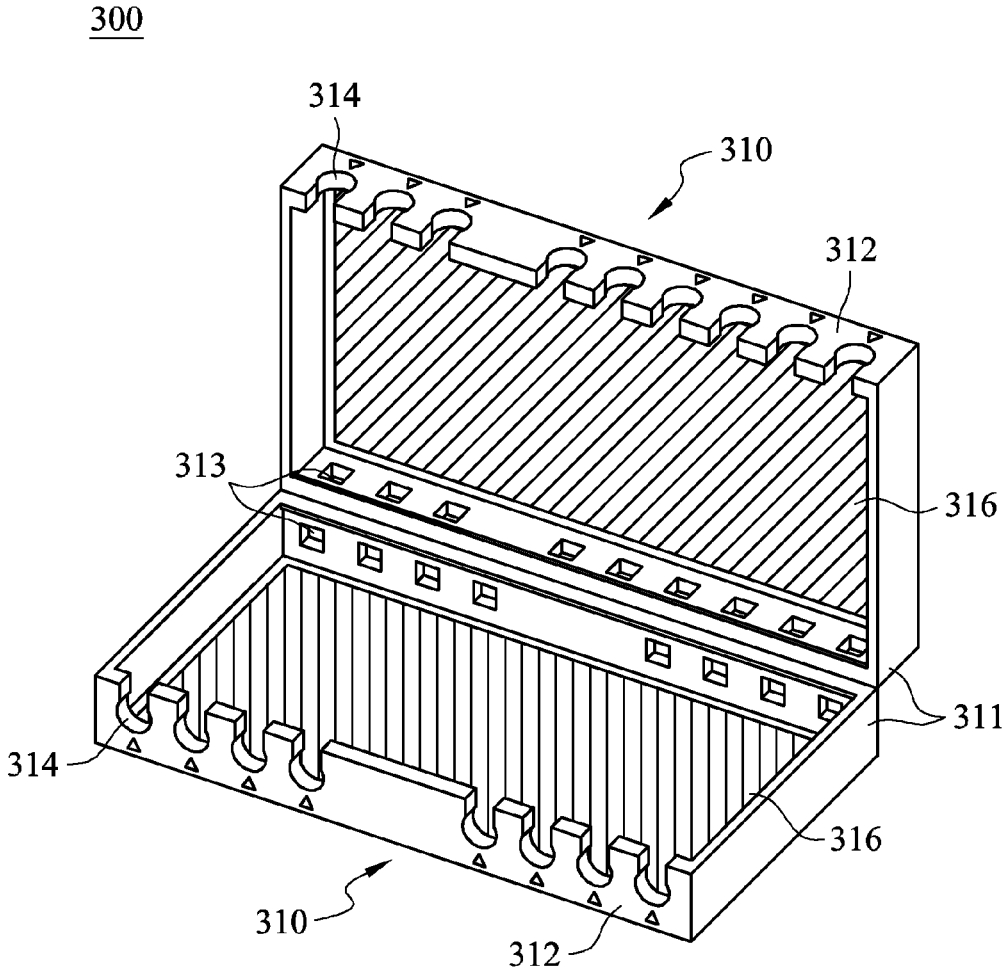
FIG. 3 is a perspective view of the cable management apparatus with the adhesion member according to the first embodiment.
Figure 4:
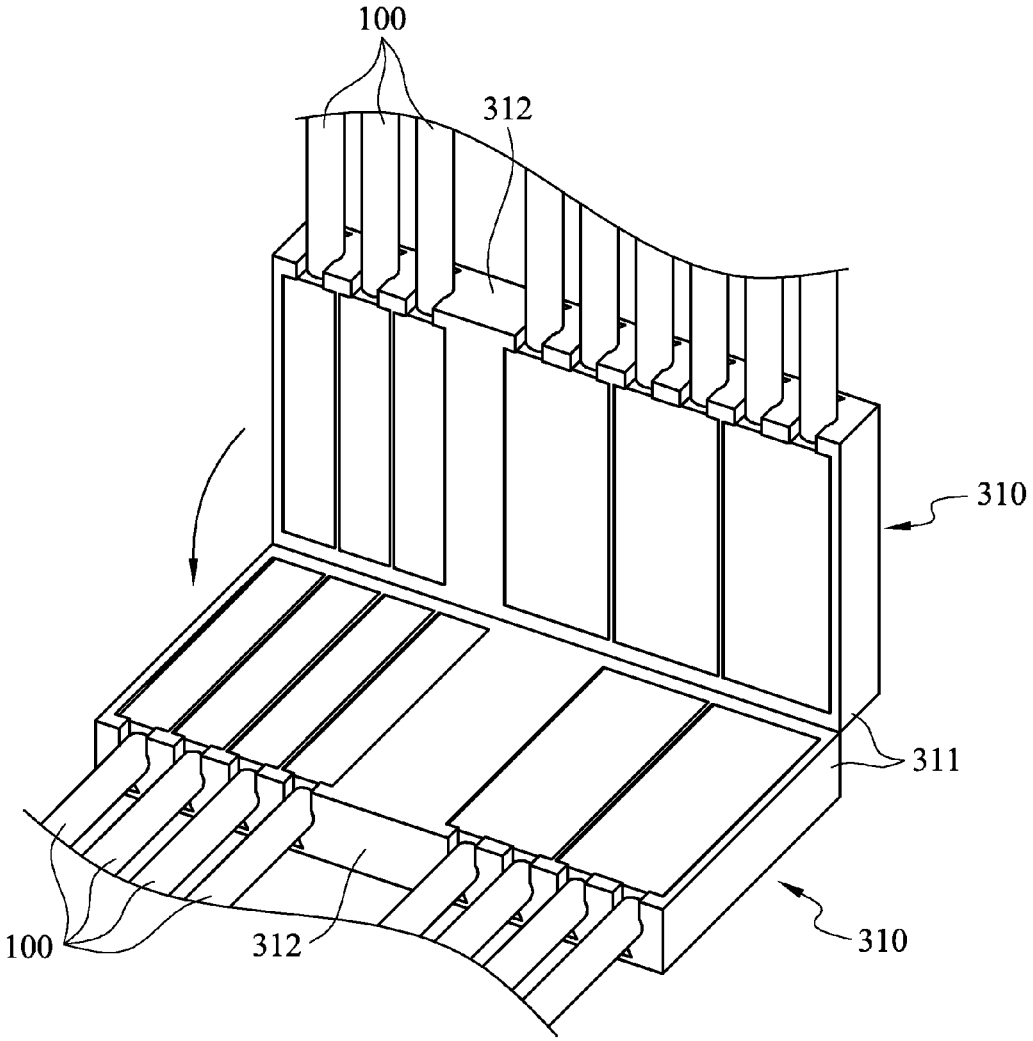
FIG. 4 is a perspective view of the cable management apparatus with multiple signal cables disposed inside according to the first embodiment.
Figure 5:
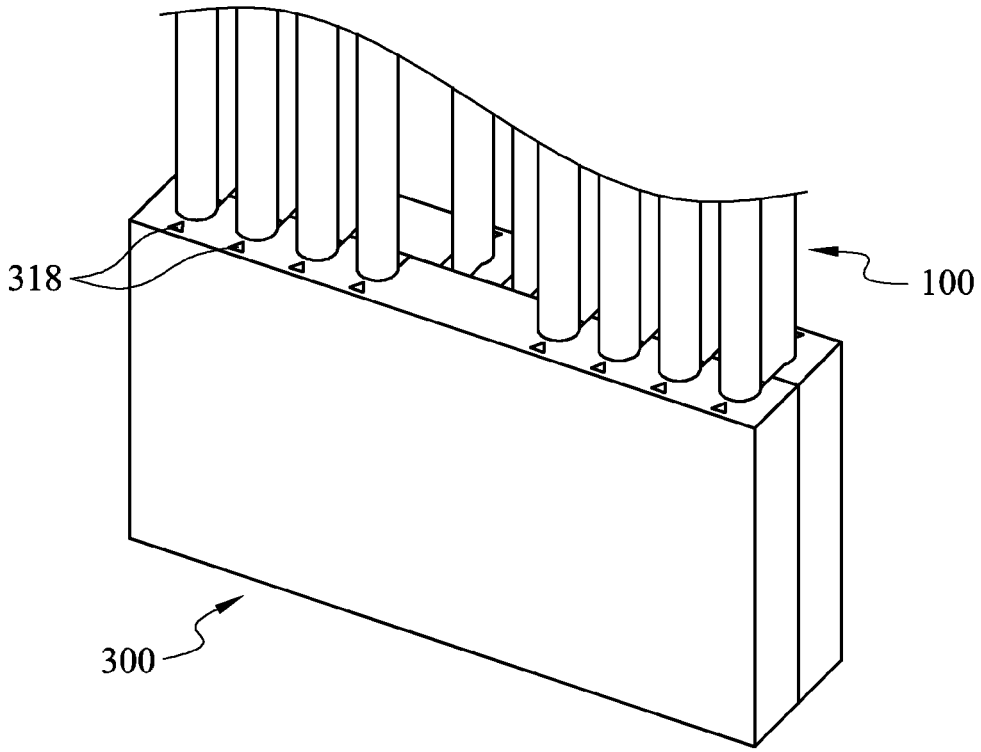
FIG. 5 is a perspective view of the combination of the cable management apparatus and multiple signal cables according to the first embodiment when the cable management apparatus is closed.
Figure 6:
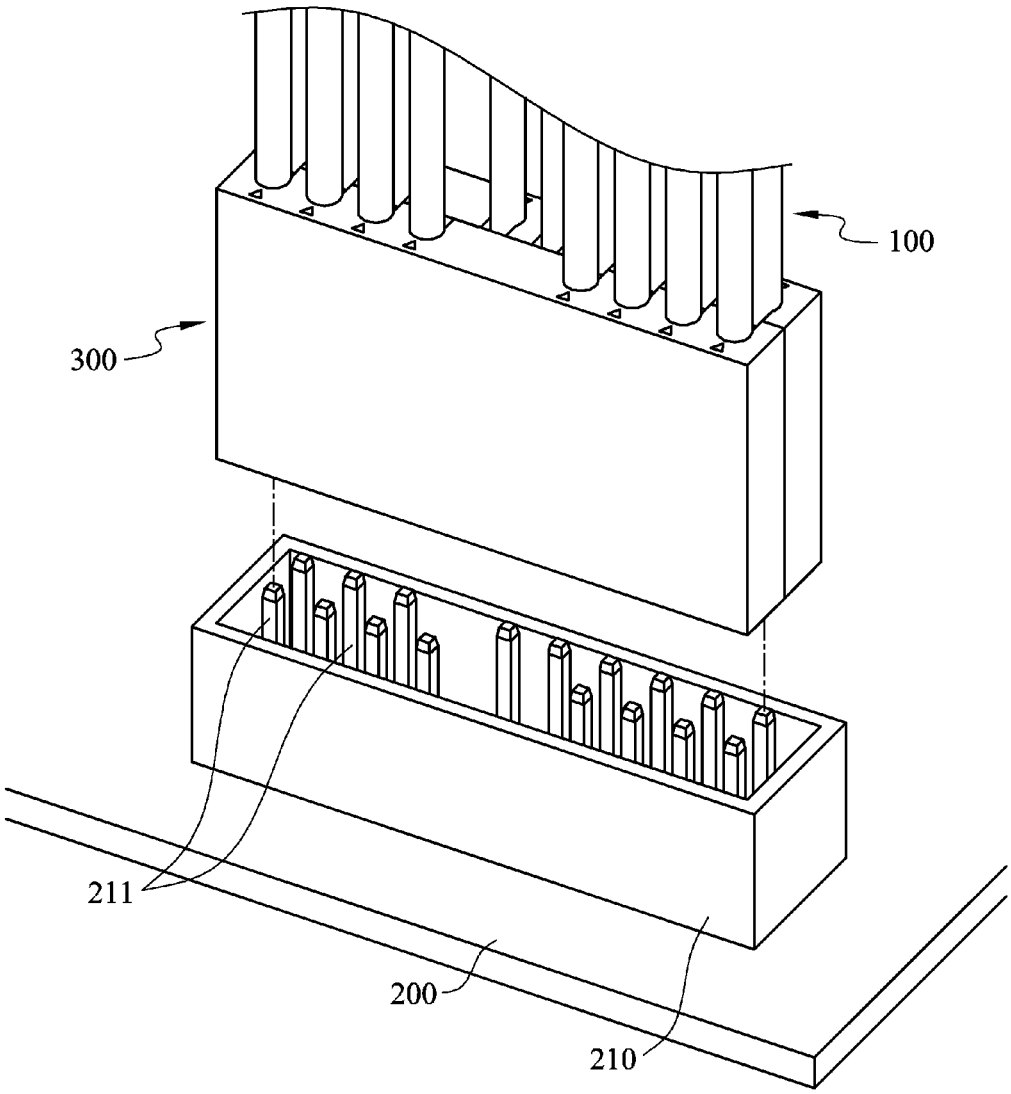
FIG. 6 is a perspective view of the cable management apparatus with multiple signal cables disposed inside and the electronic slot according to the first embodiment.
Figure 7:
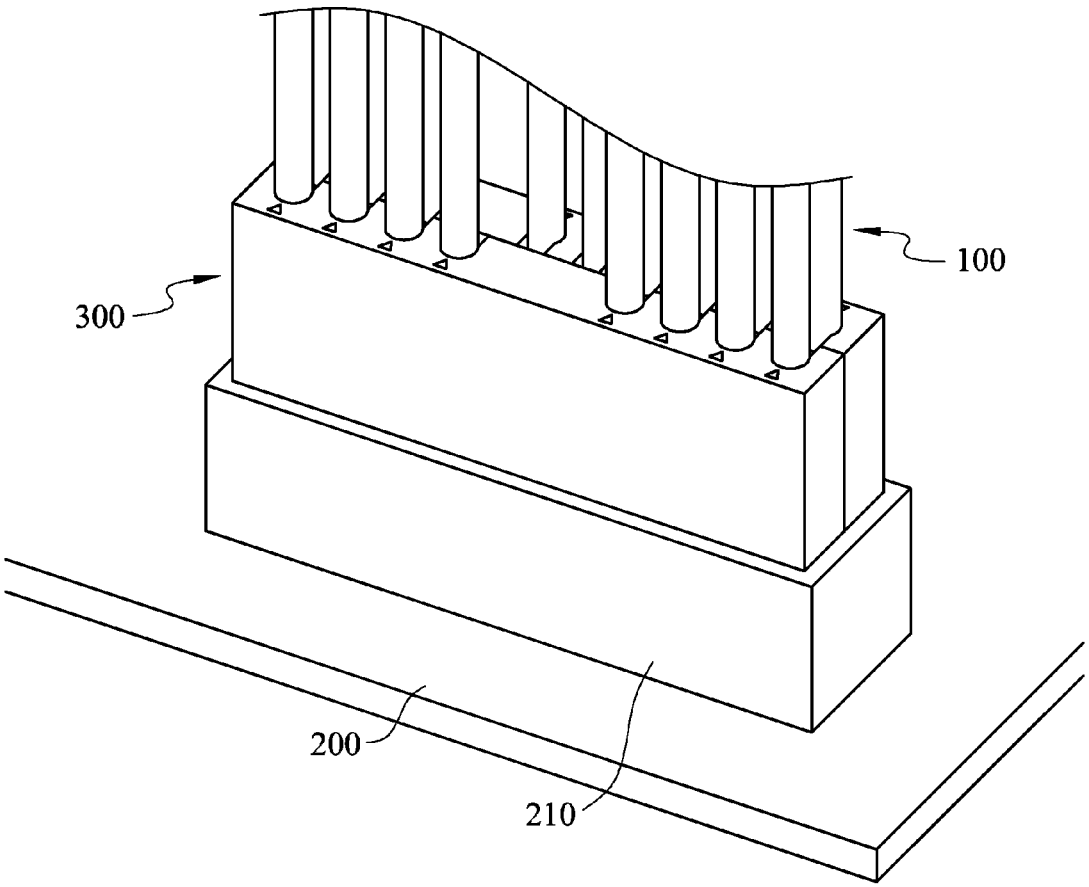
FIG. 7 is a perspective view of the cable management apparatus with multiple signal cables disposed inside inserted in the electronic slot according to the first embodiment.

To enhance the stability of the combination of the connector 110 and the half housings 310, each of the half housings 310 further includes a plurality of partitions 315 disposed inside the half housing 310. The partitions 315 could be but not limited to convex ribs or boards disposed inside the half housing 310. The partitions 315 divide the interior of the half housing 310 into a plurality of compartments 317 respectively corresponding to the positions of the pinholes 313 by the partitions 315. Refer to FIG. 3, an adhesion member 316 is disposed on each interior faces. Therefore, when the connector 110 of the signal cable 100 is placed in the half housing 310, the connector 110 can be fixed and positioned to the half housing 310 by the adhesion member 316. The adhesion member 316 could be made by a backing adhesive. People having ordinary skill in the art can make proper modification to the material of the adhesion member 316 according to the actual needs or design requirements, not limited as described herein.

The signal cables 100 are respectively disposed to the compartments 317 of the half housing 310 via the connectors 110, such that the positions of the connectors 110 correspond to that of the pinholes 313, so as to separate and position each signal cable 100. The line bodies 120 of the signal cables 100 are stuck in the corresponding fastening portion 314, so that the signal cables 100 will not loose from the half housing 310 or get entangled, so as to fix and position the signal cables. When the signal cables 100 are disposed in the half housing 310 correspondingly, second side surfaces 312 of two half housings 310 can be connected with each other, so that the half housing 310 is closed and that the signal cables 100 are fixed and positioned in the cable management apparatus 300. Hence, the signal cables 100 are placed in the electronic slot 210 via the cable management apparatus 300, and the pins 211 of the electronic slot 210 correspondingly run through the pinholes 313 of the half housing 310. The signal cables 100 are directed by the cable management apparatus 300 and are placed in the electronic slot 210 of the circuit board 200, and the connectors 110 of the signal cables 100 are electronically inserted in the pins 211, such that setting up the connection of the circuit board 200 and the signal cables 100 and correspondingly connecting the signal cables 100 and the pins 211 are easy and quick.

For easy assembling, the cable management apparatus 300 further includes a plurality of signs 318 respectively disposed on the outer face of the second side surfaces 312 of the half housing 310. The signs 318 respectively mark out the corresponding types of the signal cables 100, so as to easily identify the disposed positions of the signal cables 100. For avoiding misidentifying, the patterns of the marks 318 could be graphics, colors, numbers, or alphabets, so as to identify types of the signal cables 100, not limited as described herein. The cable management apparatus 300 further includes a locking mechanism, which is used to fix the upper part and the lower part of the half housing 310 when the half housing 310 is closed. For example, put an adhesive or set up a concave-convex fitting structure on the edge of the second side surfaces 312 of the half housing 310.

In this embodiment, the signal cables are fixed in the cable management apparatus by the structure of cable management apparatus and are placed respectively corresponding to the positions of the pins, so that the entire group of signal cables are placed in the electronic slot and that the assembling and the positioning corresponding are easy and quick. The design of the marks is used to identify the positions of different types of signal cables, so that users can assemble and position easily and quickly and that the quality and the production efficiency are enhanced. Besides, the shape of the half housing matches that of the electronic slot, and the cable management apparatus will totally merge into the electronic slot when inserted into the electronic slot, so as to avoid obstructing other electronic components on the circuit board.

Figure 8:
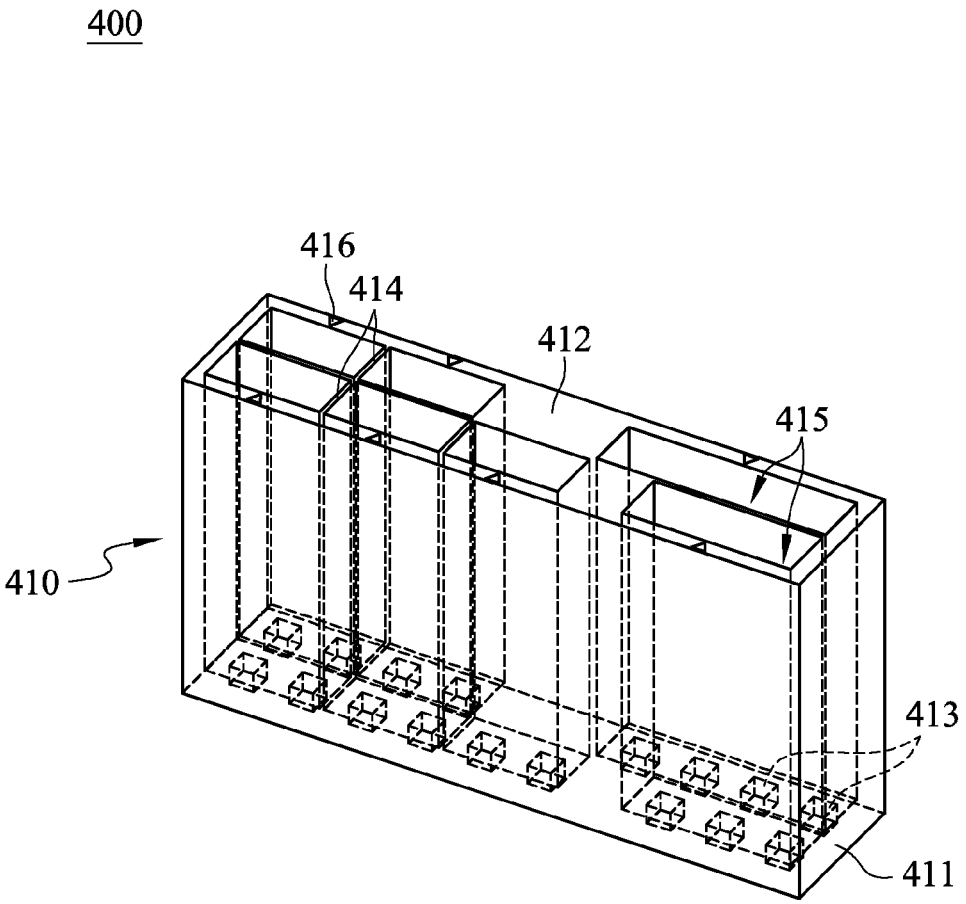
FIG. 8 is a perspective view of the cable management apparatus according to a second embodiment.
Figure 9:
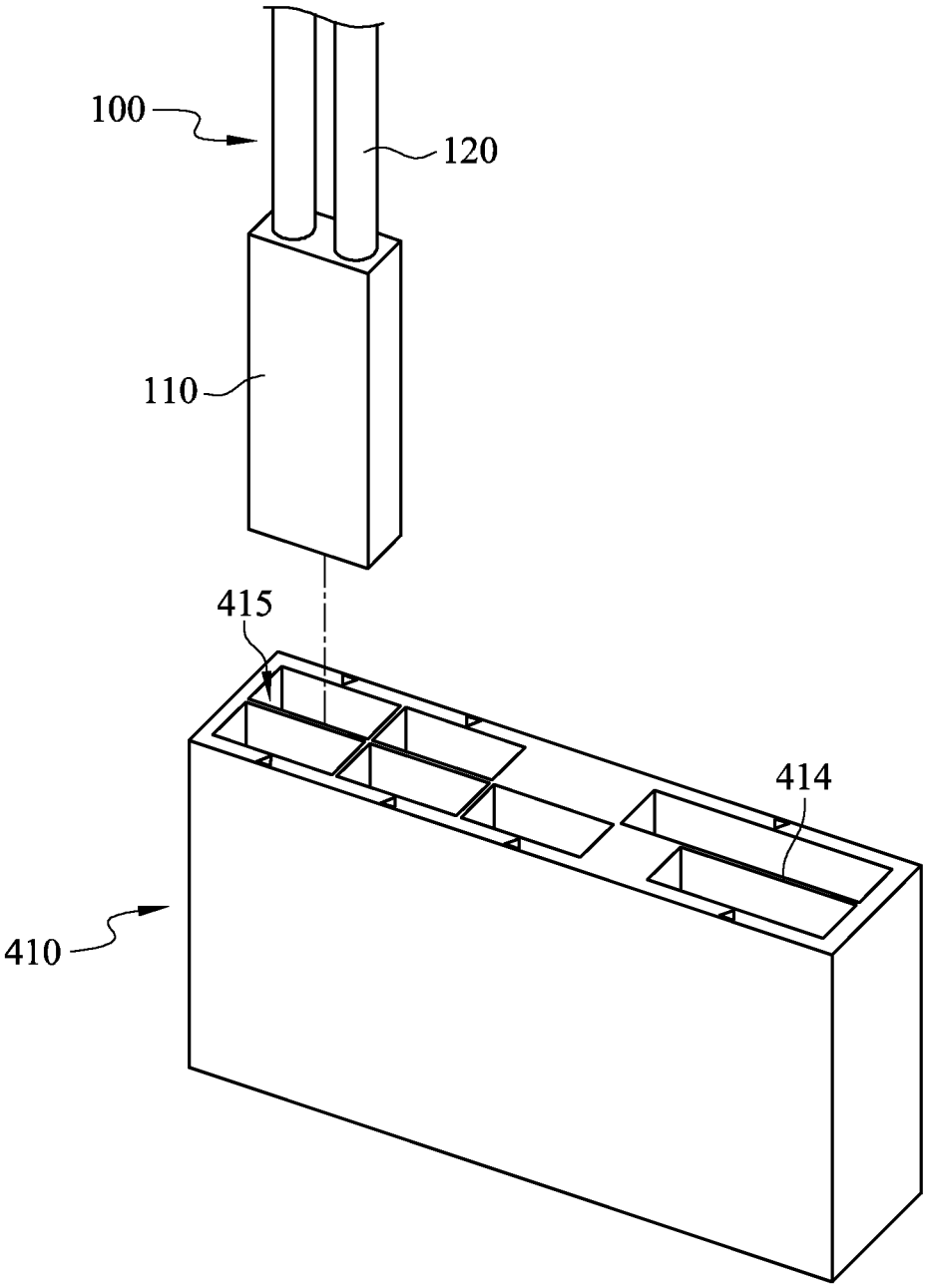
FIG. 9 is a perspective view of the cable management apparatus with one signal cable according to the second embodiment.
Figure 10:
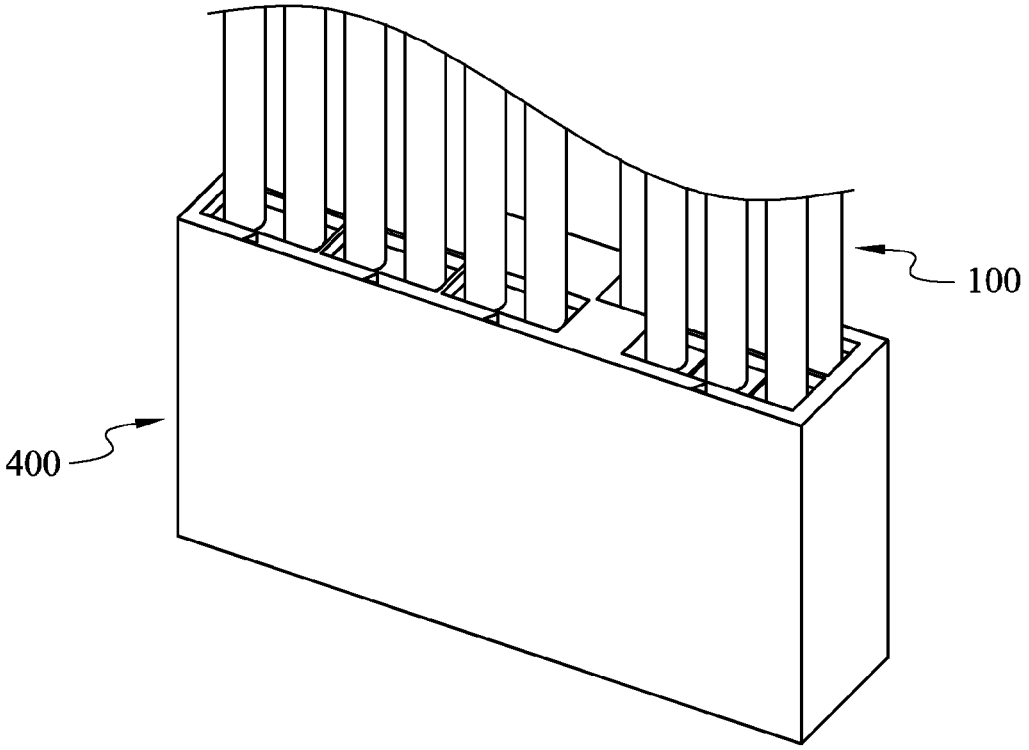
FIG. 10 is a perspective view of the combination of the cable management apparatus and the signal cables according to the second embodiment.
Figure 11:
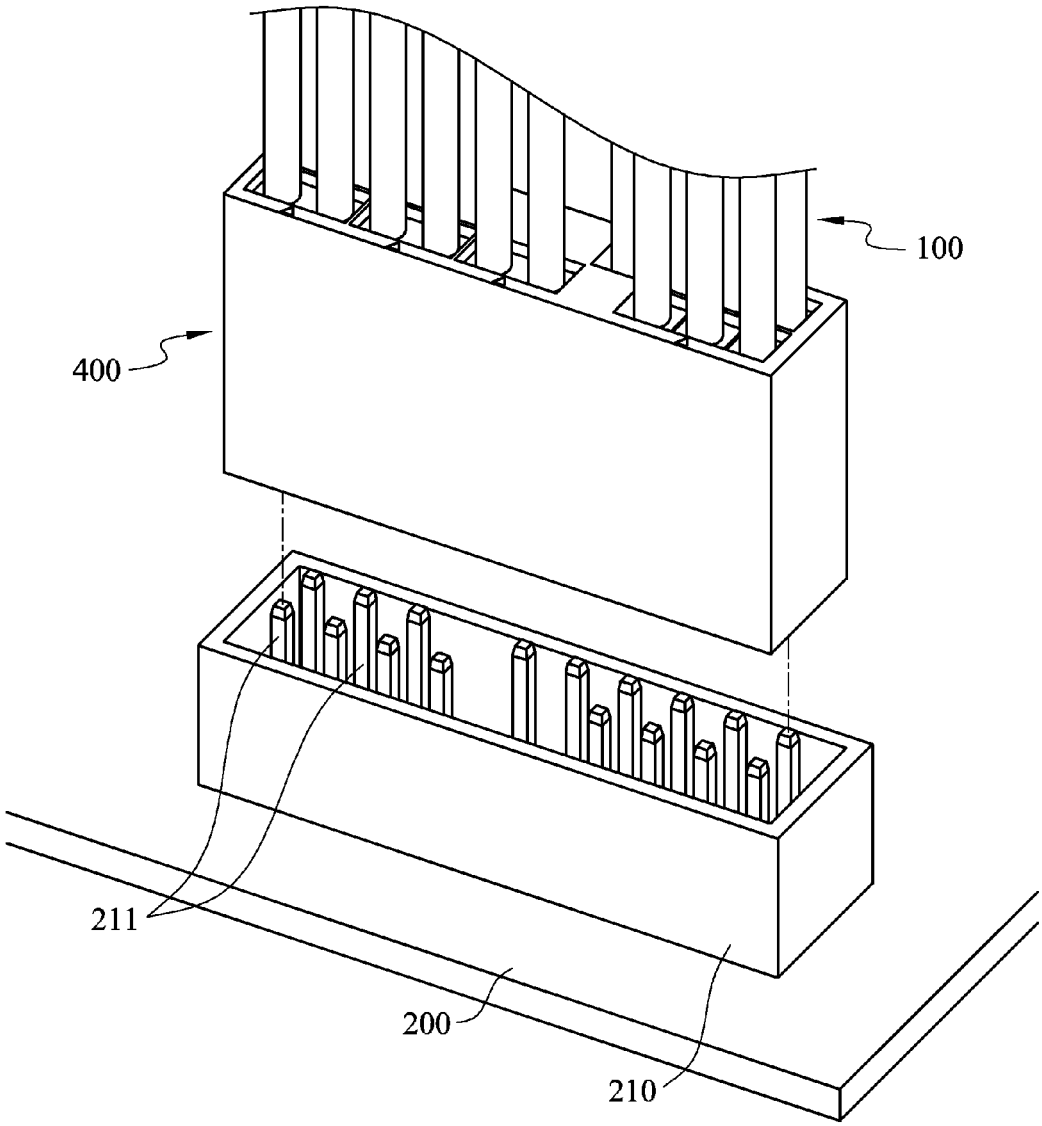
FIG. 11 is a perspective view of the cable management apparatus with multiple signal cables disposed inside and the electronic slot according to the second embodiment.
Figure 12:
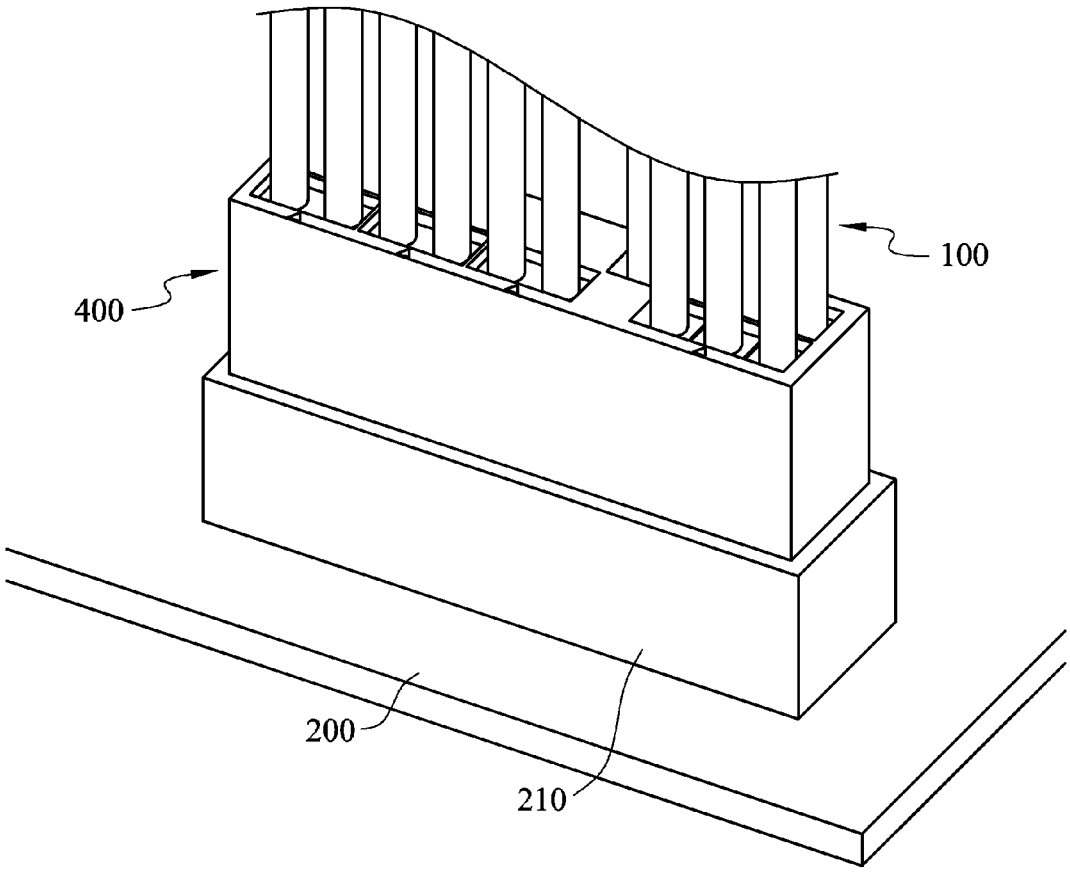
FIG. 12 is a perspective view of the cable management apparatus with multiple signal cables disposed inside inserted in the electronic slot according to the second embodiment.

Refer to FIG. 8 and FIG. 12. The structure of the cable management apparatus 400 according to the second embodiment is similar to that of the cable management apparatus 300 according to the first embodiment, and the inventor will describe in detail only the difference between those two embodiments.

The cable management apparatus 400 is used to direct a plurality of signal cables 100 to be electronically placed in an electronic slot 210 of a circuit board 200. Each signal cable 100 has a connector 110, and a plurality of pins 211 are disposed in the electronic slot 210, so as to connect the signal cables 100.

The cable management apparatus 400 includes a half housing 410 and a plurality of partitions 414. The material of the half housing 410 could be plastic or rubber, not limited as described herein. The half housing 410 has a first side surface 411 and a second side surface 412 opposite to each other. The shape of the half housing 310 is a cuboid or other shape that matches the structure of the electronic slot 210, and the half housing 310 can be inserted in the electronic slot 210. A plurality of partitions 414 are disposed inside the half housing 410 to divide the interior of the half housing 310 into a plurality of compartments 415 communicating the first side surface 411 and the second side surface 412. The compartments 415 respectively correspond to the positions of the pinholes 211 of the electronic slot 210.

Further explain the structure of the cable management apparatus 400. The first side surface 411 of the half housing 410 includes a plurality of pinhole 413 respectively corresponding to the pins 211 of the electronic slot 210 of the circuit board 200, and the positions of the pinholes 413 respectively correspond to the compartments 415; the pinholes 413 communicate exterior of the half housing 410 and the corresponding compartments 415. Therefore, when signal cables 100 are disposed in the corresponding compartments 415 of the half housing 410 via the signal cables 100, the signal cables 100 are separated and positioned in the cable management apparatus 300, and the connectors 110 are disposed respectively corresponding to the positions of the pinholes 413. Besides, when the signal cables 100 are directed to be placed in the electronic slot 210 via the cable management apparatus 400, the pins 211 of the electronic slot 210 are able to run through the pinholes 413 of the half housing 410, and the connectors 110 of the signal cables 100 are electronically inserted in the pins 211, such that setting up the connection of the circuit board 200 and the signal cables 100 and correspondingly connecting the signal cables 100 and the pins 211 are easy and quick.

For easy assembling, the cable management apparatus 400 further includes a plurality of signs 416 respectively disposed on the outer face of the second side surface 412 of the half housing 410. The signs 416 respectively mark out the corresponding types of the signal cables 100, so as to easily identify the disposed positions of the signal cables 100. For avoiding misidentifying, the patterns of the marks 318 could be graphics, colors, numbers, or alphabets, so as to identify types of the signal cables, not limited as described herein.

The structure of the cable management apparatus solve the issue that the assembly procedure of the signal cables and the circuit board are very complex and are difficult to position, such that the quality and the production efficiency can not be enhanced.

Compared with the prior art, the signal cables are fixed in the cable management apparatus and are placed respectively corresponding to the positions of the pins, so that the entire group of signal cables are placed in the electronic slot and that the assembling is easy and quick. The design of the signs is used to identify the positions of different types of signal cables, so that users can assemble and position easily and quickly and that the quality and the production efficiency are enhanced.

Though the embodiments of this disclosure are disclosed as described above, this is not to limit this disclosure. People having ordinary skill in the art will recognize that this disclosure can be practiced with modification within the spirit and scope of the claim. It is therefore to be understood that this disclosure is not to be limited by the foregoing description but only by the appended claims

What is claimed is:

1. A cable management apparatus, used to direct a plurality of signal cables to be electronically connected to an electronic slot of a circuit board, wherein each signal cable includes a connector and a line body, and a plurality of pins are disposed in the electronic slot, comprising:

two half housings, respectively including a first side surface and a second side surface opposite to each other, wherein the first side surfaces of the two half housings are connected to each other, while the second side surfaces of the two half housings are able to be connected or separated;

when the seconds side surfaces connected to each other, the whole structure of the two half housings matches the configuration of the electronic slot, an accommodation space is defined by the two half housings, and the structure of the two half housings is able to be placed in the electronic slot;

wherein the first side surface of each half housing includes a plurality of pinholes, the pinholes respectively correspond to the pins of the electronic slot, the second side surface of each half housing includes a plurality or fastening grooves formed on an edge of each seconds side surface, the fastening grooves respectively correspond to the pinholes of the first side surface, the line bodies of the signal cables are stuck in the corresponding fastening portion, and the connectors respectively corresponds to the pinholes when the connectors are disposed in the half housings.

2. The cable management apparatus as claimed in claim 1, wherein an adhesion member is disposed in the each of the half housings, and the connectors of the signal cables are combined in the half housing with the adhesion member.

3. The cable management apparatus as claimed in claim 1, wherein the half housing includes a plurality of partitions to divide the interior of the half housing into a plurality of compartments, each partition respectively corresponds to the pinholes, and the connectors of the signal cables are respectively disposed in the compartments.

4. The cable management apparatus as claimed in claim 1, further comprising a plurality of marks disposed on the outer surface of the two half housings, wherein and the marks respectively correspond to the types of the signal cables.

5. The cable management apparatus as claimed in claim 1, wherein the half housing further includes a locking mechanism, the locking mechanism fix and connect the second side surfaces of the two half housings when the half housings are closed.

* * * * *